US009862196B2

(12) United States Patent
Miyashita et al.

(10) Patent No.: US 9,862,196 B2
(45) Date of Patent: Jan. 9, 2018

(54) LIQUID CONTAINER AND RECORDING APPARATUS ON WHICH LIQUID CONTAINER IS MOUNTED

(71) Applicant: CANON KABUSHIKI KAISHA, Tokyo (JP)

(72) Inventors: Takeho Miyashita, Yokohama (JP); Yasuo Kotaki, Yokohama (JP); Tetsuya Ohashi, Matsudo (JP); Hiroki Hayashi, Kawasaki (JP); Manabu Ohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/150,135

(22) Filed: May 9, 2016

(65) Prior Publication Data

US 2016/0332451 A1 Nov. 17, 2016

(30) Foreign Application Priority Data

May 13, 2015 (JP) ..... 2015-098550
Feb. 5, 2016 (JP) ..... 2016-021319

(51) Int. Cl.
*B41J 2/175* (2006.01)

(52) U.S. Cl.
CPC ..... *B41J 2/17513* (2013.01); *B41J 2/17523* (2013.01)

(58) Field of Classification Search
CPC .. B41J 2/1752; B41J 2/17553; B41J 2/17523; B41J 2/175; B41J 2/17503; B41J 2/14024; B41J 25/34; B41J 2002/14362
USPC ..... 347/50, 85, 86
See application file for complete search history.

(56) References Cited

U.S. PATENT DOCUMENTS 6,151,051 A * 11/2000 Ikeda ..... B41J 2/14024 347/50

FOREIGN PATENT DOCUMENTS

| | | | |
|---|---|---|---|
| CN | 1274645 | A | 11/2000 |
| CN | 1521007 | A | 8/2004 |
| CN | 102673127 | A | 9/2012 |
| CN | 103241000 | A | 8/2013 |
| CN | 103302991 | A | 9/2013 |
| CN | 103476592 | A | 12/2013 |
| JP | S61-153130 | A | 7/1986 |
| JP | 2001-001544 | A | 1/2001 |
| JP | 2001-146027 | A | 5/2001 |
| JP | 2005-287541 | A | 10/2005 |
| JP | 2007-252701 | A | 10/2007 |
| JP | 2007-260170 | A | 10/2007 |

(Continued)

*Primary Examiner* — Jannelle M Lebron
(74) *Attorney, Agent, or Firm* — Canon U.S.A., Inc. IP Division

(57) ABSTRACT

A liquid container mounted on a recording apparatus and containing a liquid in a liquid containing portion, including a first surface which faces the recording apparatus when the liquid container is mounted on the recording apparatus, and a second surface opposite to the first surface, wherein the liquid containing portion has, on a bottom surface which is a lower surface in a gravity direction when the liquid container is mounted on the recording apparatus, a first inclined surface inclining downward in the gravity direction from the first surface side to the second surface side and a second inclined surface inclining upward in the gravity direction from the first surface side to the second surface side in this order from the first surface side.

20 Claims, 6 Drawing Sheets

(56) References Cited

FOREIGN PATENT DOCUMENTS

| | | | |
|---|---|---|---|
| JP | 4336505 | B2 | 9/2009 |
| JP | 2009-247749 | A | 10/2009 |

* cited by examiner

LIQUID CONTAINER AND RECORDING APPARATUS ON WHICH LIQUID CONTAINER IS MOUNTED

BACKGROUND OF THE INVENTION

Field of the Invention

The present invention relates to a liquid container which contains a liquid, and an apparatus on which the liquid container is mounted.

Description of the Related Art

A liquid container (e.g., an ink tank) is used in a recording apparatus, such as an inkjet printer. In the recording apparatus, a liquid contained in the liquid container is supplied to a liquid ejection head, and is ejected at a recording medium from the liquid ejection head to record images, characters, and the like.

If the liquid container used in the recording apparatus is left for a long time, a coloring material, resin, and the like included in the liquid may precipitate in a liquid containing portion. The images or characters recorded with that liquid may become uneven. Especially if pigment, which precipitates easily, is employed as a coloring material, liquid concentration may increase on the side of a bottom surface of the liquid container.

To address the problem, a method for stirring the liquid in the liquid container to prevent precipitation of a coloring material and the like has been proposed. Japanese Patent No. 4336505 discloses sucking a liquid via a supply pipe from the inside of a liquid container by a pump provided between a liquid ejection head and the liquid container, and blowing again the sucked liquid from the supply pipe into the liquid container. In this manner, convection is generated inside the liquid container and the liquid is stirred.

SUMMARY OF THE INVENTION

The present invention provides a liquid container containing a liquid in a liquid containing portion, including a first surface and a second surface opposite to the first surface, wherein a supply port for supplying the liquid opens at the first surface, and the liquid containing portion has, on a bottom surface which is a lower surface in a gravity direction, a first inclined surface inclining downward in the gravity direction from the first surface side to the second surface side, and a second inclined surface inclining upward in the gravity direction from the first surface side to the second surface side in this order from the first surface side.

Further features of the present invention will become apparent from the following description of exemplary embodiments with reference to the attached drawings.

DESCRIPTION OF THE EMBODIMENTS

When a liquid container is mounted on a recording apparatus, the liquid container may be moved horizontally. A supply port typically opens at a mounting surface (a front surface) of the liquid container, through which a supply pipe of the recording apparatus is inserted during mounting. From a viewpoint of consuming the liquid collected at a lower portion in the gravity direction, it is necessary that the supply port is disposed at a lower portion of the mounting surface in the gravity direction and the supply pipe inserted in the liquid container opens downward in the gravity direction. In this structure, if a liquid is blown into a liquid container through a supply pipe as disclosed in Japanese Patent No. 4336505, the liquid strikes against a bottom surface of the liquid container and is distributed to various directions. Therefore, it is difficult to generate a flow of liquid circulating the entire liquid container, and it is difficult to stir the liquid in the liquid container thoroughly.

The present invention provides a liquid container capable of stirring a liquid contained therein thoroughly, and a recording apparatus on which the liquid container is mounted.

Embodiments of the present invention are described with reference to the drawings.

Figure 1:
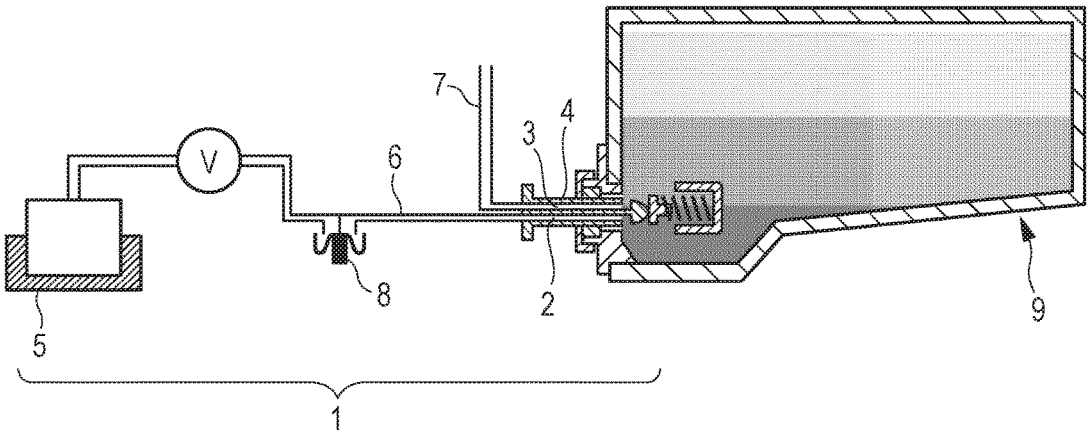
FIG. 1 illustrates a recording apparatus on which a liquid container is mounted.

FIG. 1 illustrates a recording apparatus on which a liquid container is mounted. FIG. 1 is an enlarged view of a portion near a liquid container mounting portion and a liquid ejection head of the recording apparatus. A recording apparatus 1 is provided with a liquid container 9. A supply pipe 4 of the recording apparatus 1 is inserted in the liquid container 9. The supply pipe 4 is provided with a liquid outlet 2 through which a liquid in the liquid container 9 flows out, and an air inlet 3 through which air is taken into the liquid container 9 via a path 7. The liquid flowing out via the supply pipe 4 is supplied to a liquid ejection head 5 side via a path 6.

In the liquid container 9, the air inlet 3 of the supply pipe 4 desirably opens upward in the gravity direction, and the liquid outlet 2 desirably opens downward in the gravity direction. The path 7 communicates with the air inlet 3 at the base of the supply pipe 4. An end of the path 7 opposite to the end on the side of the supply pipe 4 communicates with air. When the liquid is sucked through the liquid outlet 2 in the liquid container 9, air enters through the air inlet 3. The entered air moves upward in the gravity direction in the liquid container 9. Gas-liquid exchange is thus performed in the liquid container 9. Since the liquid outlet 2 opens downward in the gravity direction in the liquid container 9, the liquid in the liquid container 9 can be flowed out efficiently. Although the supply pipe 4 illustrated in FIG. 1 has two channels of the liquid outlet 2 and the air inlet 3 integrally, the liquid outlet 2 and the air inlet 3 may be provided in separate members. A diaphragm 8 is provided ahead of the path 6, and a valve and the liquid ejection head 5 which ejects the liquid are provided ahead of the diaphragm 8. The liquid ejection head 5 is provided with an energy generating element and an ejection port. The liquid ejection head 5 records by ejecting the liquid from the ejection port with energy generated by the energy generating element and causing the liquid to land on a recording medium, such as paper.

Figure 2A:
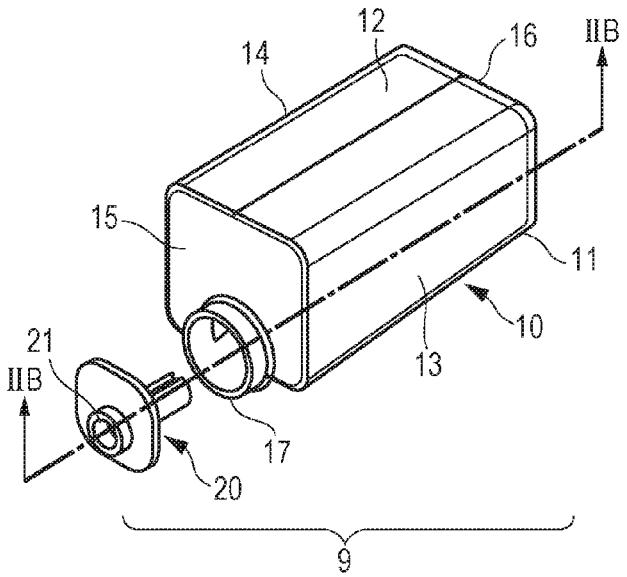
FIGS. 2A to 2C illustrate the liquid container.

The liquid container 9 is described with reference to FIGS. 2A to 2C. FIG. 2A is an exploded perspective view of the liquid container 9. The liquid container 9 is provided with a housing 10 which has a liquid containing portion containing the liquid, and a joint member 20 mounted on a first surface 15 of the liquid container 9. An opening 21 opens at the joint member 20. The opening 21 is located at a position corresponding to a supply port 17 of the first surface 15 and is considered to be a part of the supply port 17. A surface of the liquid container 9 which faces the recording apparatus 1 when the liquid container 9 is mounted on the recording apparatus 1 (a mounting surface) is the first surface 15. A surface opposite to the first surface 15 via the liquid containing portion is a second surface 16. The first surface 15 and the second surface 16 are connected to each other by a third surface 11, which is a lower surface, a fourth surface 12, which is an upper surface, and a fifth surface 13 and a sixth surface 14 which are side surfaces.

Figure 2B:
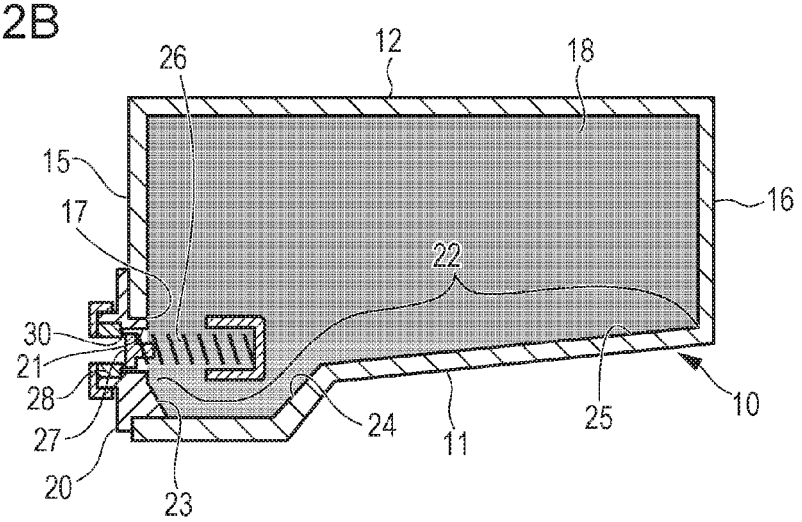
Figure 2C:
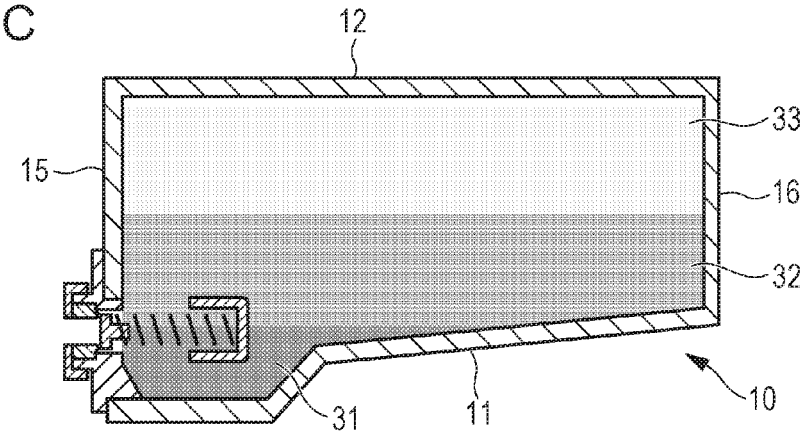

FIG. 2B is a cross-sectional view of the liquid container 9 along line IIB-IIB of FIG. 2A. As described above, the liquid container 9 has the first surface 15 which becomes a front surface in a mounting direction, the second surface 16 on the opposite side, the third surface 11, and the fourth surface 12. The supply port 17 opens at the first surface 15. The supply port 17 opens at a position lower in the gravity direction than the center line of the first surface 15 in the gravity direction when the liquid container 9 is mounted on the recording apparatus 1. The supply port 17 extends along a direction in which the supply pipe 4 is inserted. A liquid containing portion 18 is provided in the housing 10 of the liquid container 9. The liquid containing portion 18, which contains the liquid, has a bottom surface 22 which becomes a lower surface in the gravity direction when the liquid container 9 is mounted on the recording apparatus 1. The bottom surface 22 has a first inclined surface 23 inclining downward in the gravity direction from the first surface 15 side to the second surface 16 side, and a second inclined surface 24 inclining upward in the gravity direction from the first surface 15 side to the second surface 16 side in this order from the first surface side. That is, the first inclined surface 23 is located at a position closer to the first surface 15 than to the second inclined surface 24 in the bottom surface 22. The first surface 15 and the second surface 16 are disposed with a gap therebetween. Although the first inclined surface 23 inclines from the first surface 15 toward the bottom surface in FIG. 2B, it is only necessary that the first inclined surface 23 is located closer to the first surface 15 than to the second inclined surface 24. For example, a surface parallel to the bottom surface may extend from the first surface 15, and the first inclined surface 23 may be disposed ahead the surface, i.e., separated from the first surface 15. The same applies to the second inclined surface 24. The second inclined surface 24 may be separated from the second surface 16 as illustrated in FIG. 2B, or may be inclined from the second surface 16 toward the bottom surface. In FIG. 2B, a third inclined surface 25 inclining upward in the gravity direction from the first surface 15 side to the second surface 16 side is located at a position closer to the second surface 16 than to the second inclined surface 24 in the bottom surface 22.

On the first surface 15, the joint member 20 is welded at a portion of the supply port 17. The opening 21 which becomes the supply port opens at the joint member 20. An elastic member 26, a valve 27, and a sealing member 28 are assembled in the opening 21 in this order. When the liquid container 9 is not mounted on the recording apparatus 1, the valve 27 is urged against the sealing member 28 by the elastic member 26. A cap 29 for fixing the sealing member 28 is provided at an end of the opening 21. The sealing member 28 is flexible and is formed by a rubber material, such as butyl rubber, and a thermoplastic resin material, such as elastomer. The sealing member 28 has an annular shape which opens at the center. The opening of the sealing member 28 is sealed by the valve 27 abutting against the same. An outer periphery of the sealing member 28 is made to abut against an inner wall of the joint member 20. Therefore, airtightness between the sealing member 28 and the joint member 20 is provided. A lip-like projection 30 is formed at a periphery of the opening of an inner side of the housing 10 in the sealing member 28. The valve 27 is made to abut against the projection 30 to increase adhesiveness. In this manner, since the outer periphery of the sealing member 28 is in close contact with the joint member 20 and the opening of the sealing member 28 is in close contact with the valve 27, liquid leak from the inside of the liquid container 9 or modification in the liquid due to evaporation of the liquid can be prevented. Although the supply port 17 is opened and closed by a valve spring method using a spring as the elastic member 26, the supply port 17 may be closed by, for example, a rubber plug which seals the supply port 17 when the liquid container 9 is not mounted on the recording apparatus 1 and opens the supply port 17 when the liquid container 9 is mounted on the recording apparatus 1.

In the liquid containing portion 18 of the liquid container 9, a coloring material and the like may precipitate in the liquid when, for example, the liquid is left for a long time. Especially when the coloring material is a pigment and the liquid includes the pigment, the coloring material easily precipitates in the liquid. FIG. 2C schematically illustrates a state in which the coloring material has precipitated in the liquid containing portion 18. Here, the liquid is separated into three layers. Since the coloring material easily precipitates and collects in a region 31 on the side closer to the bottom surface, color material concentration is high in the region 31. Coloring material concentration is average in an upper region 32, and low in a region 33 on the side closest to the upper surface. If recording is performed with the liquid supplied to the liquid ejection head 5 from the liquid container 9 in this state, images and characters are formed unevenly. For example, the color of images formed in the initial stage may be thick, while the color of images formed in the latter half may be thin. To prevent this phenomenon, it is necessary to stir the liquid in the liquid containing portion 18.

Figure 3A:
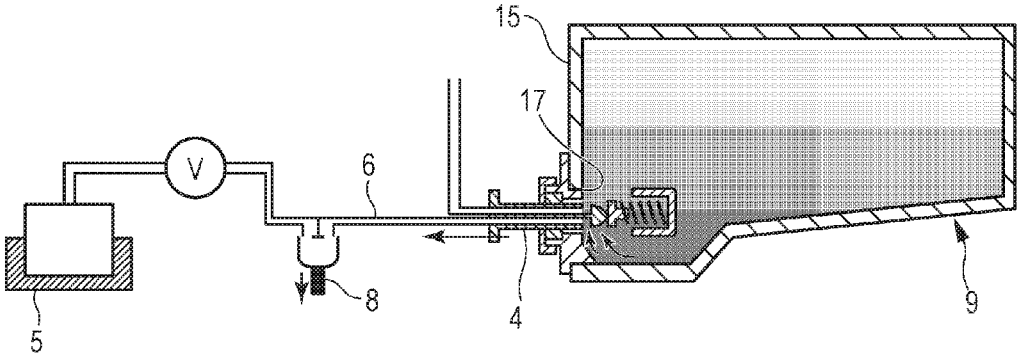
FIGS. 3A and 3B illustrate stirring of a liquid inside a liquid containing portion.
Figure 3B:
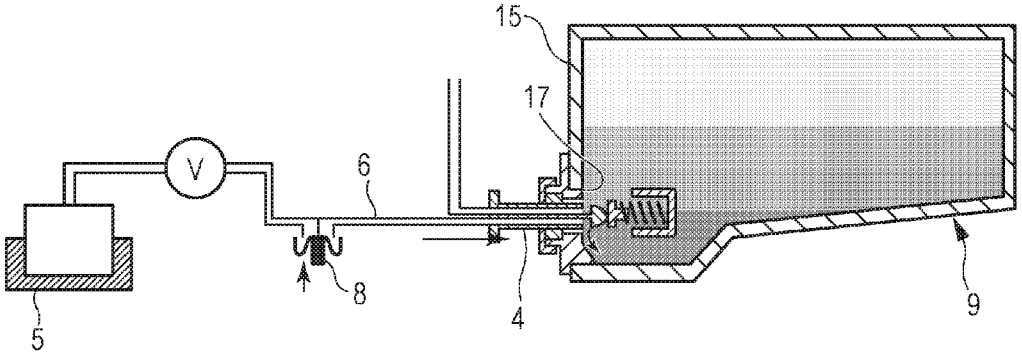

FIGS. 3A and 3B illustrate a state in which the liquid containing portion 18 of the liquid container 9 is being stirred. The recording apparatus 1 is provided with the diaphragm 8 for sucking the liquid in the liquid container 9, or blowing the liquid into the liquid container 9. A valve is provided between the diaphragm 8 and the liquid ejection head 5. The valve is closed during stirring.

First, as illustrated in FIG. 3A, when the diaphragm 8 is stretched by the recording apparatus 1, the liquid in the liquid containing portion 18 is sucked into the diaphragm 8 via the path 6 from the supply port 17. If the supply port 17 opens downward in the gravity direction of the first surface 15, the liquid on the side of the bottom surface on which the coloring material and the like easily precipitates can be sucked. Therefore, the supply port 17 desirably opens lower than the center in the gravity direction in the first surface 15.

When the diaphragm 8 is contracted by the recording apparatus 1, as illustrated in FIG. 3B, the sucked liquid flows backward toward the liquid containing portion 18 via the path 6, and is blown into the liquid containing portion 18 from the supply port 17. The sucking of the liquid out of the liquid containing portion 18 and the blowing of the liquid into the liquid containing portion 18 cause the coloring material and the like collected on the bottom surface of the liquid containing portion 18 to spread over the entire region in the liquid containing portion 18 to stir the liquid. That is, the liquid in the liquid containing portion 18 is once sucked into the recording apparatus 1 and then blown back to the liquid containing portion 18, whereby the liquid is supplied again to the liquid containing portion 18. The liquid is thus stirred.

Next, a relationship between stirring of the liquid and the inclined surfaces of the bottom surface is described with reference to FIG. 4. The liquid is blown into the liquid containing portion 18 from an opening 34 of the supply pipe 4. The opening 34 of the supply pipe 4 desirably opens downward in the gravity direction. The liquid blown into the liquid containing portion 18 flows fast downward in the gravity direction toward the second surface 16 from the first surface 15 by the first inclined surface 23. That is, the liquid supplied to the liquid containing portion 18 via the supply pipe 4 from the supply port 17 flows along the first inclined surface 23 first. Therefore, the opening 34 of the supply pipe 4 inserted in the liquid containing portion 18 desirably disposes upward in the gravity direction of the first inclined surface 23 so as to face the first inclined surface 23. That is, the first inclined surface 23 is desirably located to face the opening 34 of the supply pipe 4 when the supply pipe 4 provided in the recording apparatus 1 is inserted in the supply port 17. The liquid flowed toward the second surface 16 is then blown upward in the gravity direction toward the second surface 16 by the second inclined surface 24. That is, the liquid which flowed along the first inclined surface 23 flows toward the second surface 16 and, upon reaching the second inclined surface 24, the liquid flows upward in the gravity direction along the second inclined surface 24. Since the flowing liquid is blown up through the region 31 in which a large amount of coloring material and the like precipitates, the liquid in the region 31 can be spread in the entire liquid containing portion 18. As described above, since the liquid containing portion 18 of the present invention has the first inclined surface 23 and the second inclined surface 24 in this order from the first surface 15 side on the bottom surface, the internal liquid can be stirred thoroughly.

Figure 5:
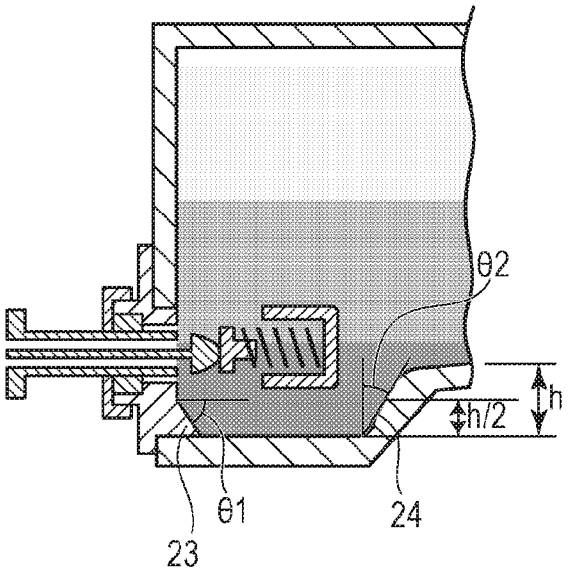
FIG. 5 is an enlarged view of a portion including a first inclined surface and a second inclined surface of the liquid containing portion.

The first inclined surface 23 and the second inclined surface 24 are described in more detail with reference to FIG. 5.

The first inclined surface 23 has a function to cause the liquid blown into the liquid containing portion 18 to flow fast downward in the gravity direction and toward the second surface 16 from the first surface 15. If an angle θ1 between the first inclined surface 23 and the horizontal plane becomes excessively large in the liquid containing portion 18, the liquid blown into the liquid containing portion 18 and the first inclined surface 23 are less easily brought into contact and the liquid flows less faster. Therefore, the angle θ1 is desirably set to 45° or less. If, on the other hand, the angle θ1 is excessively small, the liquid flows less faster toward the second surface 16. Therefore, the angle θ1 is desirably set to 10° or greater. The supply port 17 opens at the first surface 15. The supply port 17 extends to penetrate the first surface 15. The direction in which the supply port 17 extends is parallel to the horizontal plane. That is, the angle θ1 can be considered to be an angle made by the first inclined surface 23 and the surface parallel to the direction in which the supply port 17 extends.

The second inclined surface 24 has a function to cause the liquid flowing toward the second surface 16 by the first inclined surface 23 to blow upward in the gravity direction and toward the second surface 16 again. With the flow of the liquid, the liquid in the region 31 of high concentration can be caused to enter the region 32 of average concentration, and the region 33 of low concentration to stir the liquid. When the liquid reaches the region 33, the liquid blown upward is distributed in the direction of the first surface 15 and the second surface 16 as illustrated in FIG. 4. Therefore, the liquid is stirred in the entire liquid containing portion 18. If an angle θ2 between the second inclined surface 24 and the vertical plane (a surface vertical to the horizontal plane, i.e., a surface parallel to the gravity direction) is excessively small in the liquid containing portion 18, the second inclined surface 24 becomes substantially vertical to the liquid flowing from the first inclined surface 23. Therefore, the flow of the liquid collides with the second inclined surface 24, lowers in speed and is distributed, whereby blowing upward in the gravity direction or moving toward the second surface 16 becomes difficult. Therefore, the angle θ2 is desirably set to 30° or greater. If, on the other hand, the angle θ2 is excessively large, the flow toward the second surface 16 is obtained but blowing the liquid upward in the gravity direction is difficult. Therefore, the angle θ2 is desirably set to 60° or less. A surface vertical to the direction in which the supply port 17 extends is parallel to the vertical plane. That is, the angle θ2 is an angle made by the second inclined surface 24 and the surface vertical to the direction in which the supply port 17 extends.

The first inclined surface 23 and the second inclined surface 24 extend linearly ideally, and the above description is given based on this presumption, but the first inclined surface 23 and the second inclined surface 24 may be bent. If the housing 10 is manufactured by, for example, blow molding, the second inclined surface 24 is bent easily. In this case, the angle θ2 between the second inclined surface 24 and the vertical plane is an angle made by a tangent of the second inclined surface 24 at an intermediate point of the height of the second inclined surface 24 in the gravity direction (herein "h"), i.e., a tangent of the second inclined surface 24 at "h/2" and the vertical plane. The same applies to the angle θ1 between the first inclined surface 23 and the horizontal plane. If the first inclined surface 23 is bent, the angle θ1 is an angle made by a tangent of the first inclined surface 23 at an intermediate point of the height in the gravity direction of the first inclined surface 23 and the horizontal plane.

Figure 6:
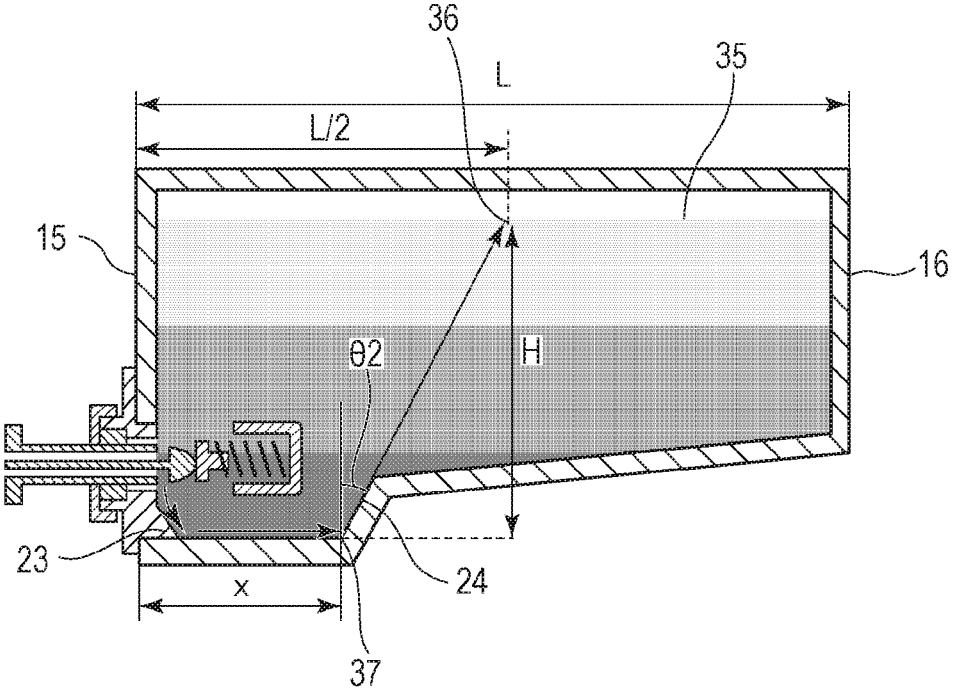
FIG. 6 illustrates stirring of a liquid inside the liquid containing portion.

As described above, the second inclined surface 24 has a function to blow the liquid flowing toward the second surface 16 by the first inclined surface 23 upward in the gravity direction and toward the second surface 16. The liquid blown upward is distributed in the direction of the first surface 15 and the second surface 16, and is stirred in the entire liquid containing portion 18. Here, as illustrated in FIG. 6, the liquid blown upward has a component in the direction of the second surface 16 by the second inclined surface 24, and easily flows closer to the second surface than to the first surface. Considering this fact, in order to stir the inside of the liquid containing portion 18 thoroughly, a position 36 at which the liquid reaches a liquid surface 35 is desirably set to an intermediate point of the first surface 15 and the second surface 16 or a position closer to the first surface 15 than to the intermediate point. That is, when a horizontal distance between the first surface 15 and the second surface 16 is defined as "L," the position 36 at which the liquid reaches the liquid surface 35 is desirably a position of "L/2" from the first surface 15 or a position closer to the first surface 15 than to the position of "L/2." FIG. 6 illustrates a state in which the position 36 is located at the position of "L/2," i.e., the intermediate point.

Here, as illustrated in FIG. 6, a horizontal distance from the first surface 15 to the lowermost point 37 in the gravity direction of the second inclined surface 24 is defined as "X," and a height in the gravity direction from the point 37 to the liquid surface 35 is defined as "H." By setting "X" to "$(L/2)/2-H \tan \theta 2 \leq X \leq L/2-H \tan \theta 2$," the position 36 can be set to the position of "L/2" from the first surface 15 or the position closer to the first surface 15 than to the position of "L/2."

The liquid blown upward does not necessarily have to reach the liquid surface 35. If the liquid does not reach the liquid surface 35, i.e., if, for example, the liquid stops at a position slightly below the liquid surface 35 in the gravity direction, the position 36 at which the liquid reaches the liquid surface 35 can be considered to be a position at which the liquid blown upward from the second inclined surface 24 reaches the liquid surface 35 linearly.

Figure 4:
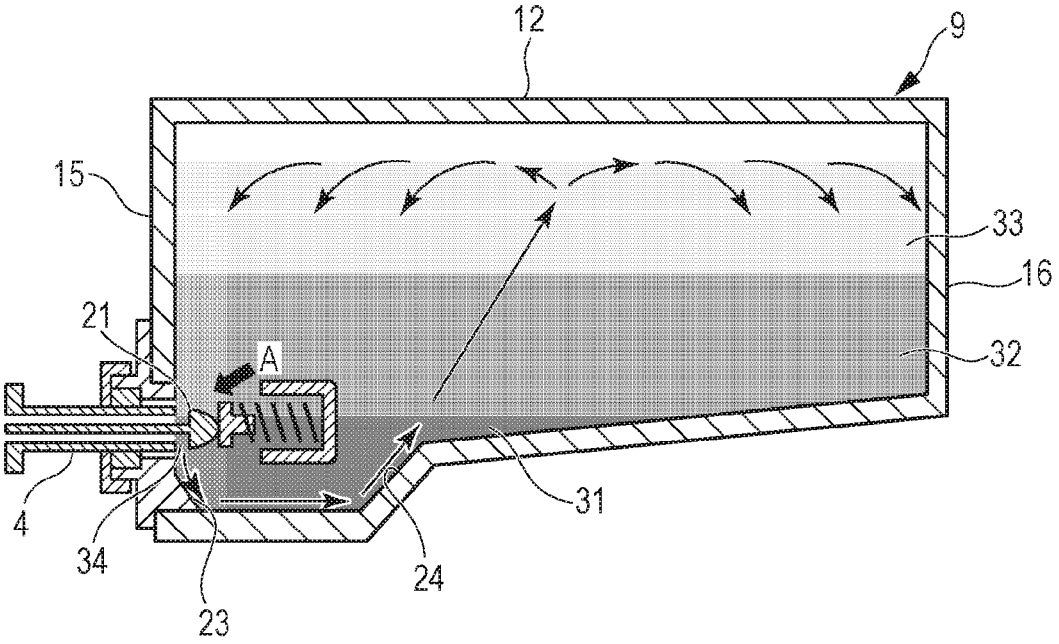
FIG. 4 illustrates stirring of a liquid inside the liquid containing portion.
Figure 7A:
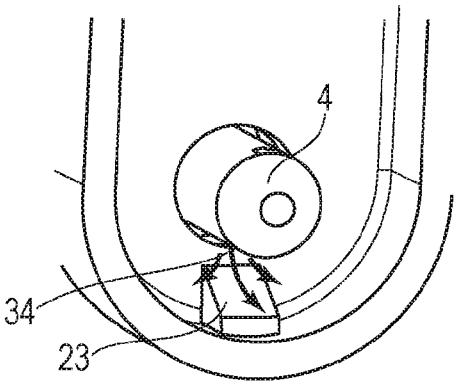
FIGS. 7A and 7B illustrate the first inclined surface of the liquid containing portion.
Figure 7B:
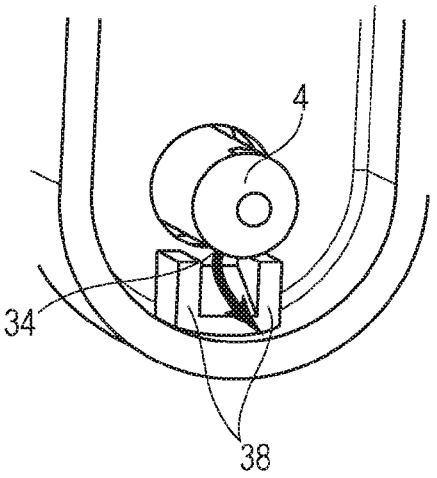

FIGS. 7A and 7B illustrate the supply pipe 4 of the liquid containing portion 18 illustrated in FIG. 4 seen from the direction "A." As illustrated in FIG. 7A, the liquid is blown from the opening 34 of the supply pipe 4. The blown liquid collides with the first inclined surface 23 and flows toward the second inclined surface 24. The first inclined surface 23 desirably has a side wall 38 as illustrated in FIG. 7B. The side wall 38 regulates the flow of the liquid and increases the speed of the flow of the liquid toward the second inclined surface 24 from the first inclined surface 23, whereby stirring efficiency increases.

Figure 8A:
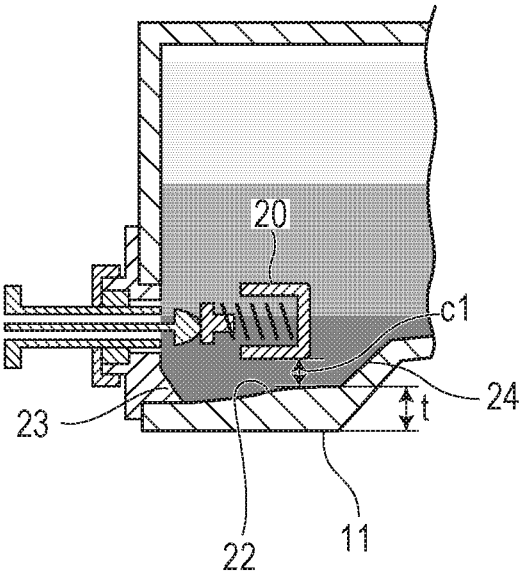
FIGS. 8A and 8B are enlarged views of a portion including the first inclined surface and the second inclined surface of the liquid containing portion.
Figure 8B:
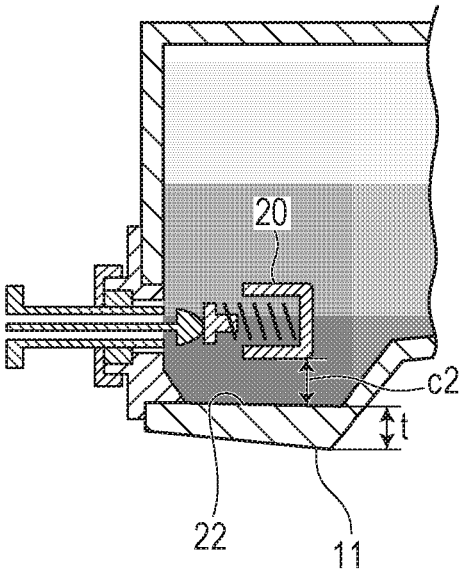

If the housing 10 forming the liquid containing portion 18 is formed by blow molding, as illustrated in FIGS. 8A and 8B, a portion between the first inclined surface 23 and the second inclined surface 24 and a portion near the second inclined surface 24 may become thicker. That is, the thickness between the third surface 11 and the bottom surface 22 represented by "t" in FIGS. 8A and 8B becomes larger. Therefore, a distance "c (C1, C2)" between the joint member 20 and the bottom surface 22 becomes shorter, and the flow of the liquid becomes slower. Then, a portion of the housing 10 at a lower portion in the gravity direction in a region between the first inclined surface 23 and the second inclined surface 24 is inclined downward in the gravity direction toward the second surface 16 from the first surface 15 as illustrated in FIG. 8B. Therefore, the distance "c2" between the joint member 20 and the bottom surface 22 is obtained, and the liquid is stirred thoroughly by the flow of the liquid.

As illustrated in FIG. 2B, the liquid container 9 desirably has the third inclined surface 25 inclining upward in the gravity direction from the first surface 15 side to the second surface 16 side. With the thus-inclining third inclined surface 25, the coloring material and the like precipitating on the bottom surface 22 easily move from the second surface 16 side to the first surface 15 side. In this manner, the liquid blown from the supply pipe 4 can be made to collide with the portion at which the coloring material and the like has collected as directly as possible, and a stirring effect is improved. The second inclined surface 24 is desirably located at a position lower than the third inclined surface 25 in the gravity direction. In this manner, the liquid can be collected toward the first surface 15 in the liquid containing portion 18, and the liquid can be consumed thoroughly from the supply port 17 which opens at the first surface 15. Further, stirring efficiency of the liquid is increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-098550, filed May 13, 2015, and No. 2016-021319, filed Feb. 5, 2016, which are hereby incorporated by reference herein in their entirety.

What is claimed is:

1. An ink tank containing a liquid in a liquid containing portion, comprising:

a first surface and a second surface opposite to the first surface, wherein a supply port for supplying the liquid opens at the first surface, and the liquid containing portion has, on a bottom surface which is a lower surface in a gravity direction and connects the first surface to the second surface, a first inclined surface inclining downward in the gravity direction from the first surface side to the second surface side, a second inclined surface inclining upward in the gravity direction from the first surface side to the second surface side, and a third inclined surface inclining upward in the gravity direction from the first surface side to the second surface side at a position closer to the second surface than to the second inclined surface in this order from the first surface side.

2. The ink tank according to claim 1, wherein the first surface is a surface which faces a recording apparatus when the liquid container is mounted on the recording apparatus.

3. The ink tank according to claim 1, wherein the first inclined surface is located to face an opening of a supply pipe when the supply pipe of the recording apparatus is inserted in the supply port.

4. The ink tank according to claim 1, wherein the second inclined surface is located at a lower position in the gravity direction than the third inclined surface.

5. The ink tank according to claim 1, wherein the angle $\theta 1$ between the first inclined surface and a surface parallel to a direction in which the supply port extends is 45° or less.

6. The ink tank according to claim 1, wherein the liquid contains pigment.

7. The ink tank according to claim 1, wherein the second inclined surface is connected to the third inclined surface directly.

8. The ink tank according to claim 1, wherein the ink tank has an elastic member in the liquid containing portion, and the first inclined surface is located just under the elastic member.

9. The ink tank according to claim 1, wherein the first surface is parallel to the second surface.

10. An ink tank containing a liquid in a liquid containing portion, comprising:

a first surface and a second surface opposite to the first surface, wherein a supply port for supplying the liquid opens at the first surface, and the liquid containing portion has a bottom surface which is a lower surface in a gravity direction and connects the first surface to the second surface, and wherein the bottom surface includes a first inclined surface inclining downward in the gravity direction from the first surface side to the second surface side, a second inclined surface inclining upward in the gravity direction from the first surface side to the second surface side, and a third inclined surface inclining upward in the gravity direction from the first surface side to the second surface side at a position closer to the second surface than to the second inclined surface in this order from the first surface side.

11. The ink tank according to claim 10, wherein the first surface is a surface which faces a recording apparatus when the liquid container is mounted on the recording apparatus.

12. The ink tank according to claim 10, wherein the first inclined surface is located to face an opening of a supply pipe when the supply pipe of the recording apparatus is inserted in the supply port.

13. The ink tank according to claim 10, wherein the second inclined surface is located at a lower position in the gravity direction than the third inclined surface.

14. The ink tank according to claim 10, wherein the angle θ1 between the first inclined surface and a surface parallel to a direction in which the supply port extends is 45° or less.

15. The ink tank according to claim 10, wherein the liquid contains pigment.

16. The ink tank according to claim 10, wherein the second inclined surface is connected to the third inclined surface directly.

17. The ink tank according to claim 10, wherein the ink tank has an elastic member in the liquid containing portion, and the first inclined surface is located just under the elastic member.

18. The ink tank according to claim 10, wherein the first surface is parallel to the second surface.

19. A recording apparatus on which an ink tank is mounted and which has a liquid ejection head for ejecting a liquid, the ink tank containing the liquid in a liquid containing portion and comprising a first surface, and a second surface opposite to the first surface, wherein a supply port for supplying the liquid opens at the first surface, and the liquid containing portion has; a bottom surface which is a lower surface in a gravity direction and connects the first surface to the second surface, wherein the bottom surface includes a first inclined surface inclining downward in the gravity direction from the first surface side to the second surface side, a second inclined surface inclining upward in the gravity direction from the first surface side to the second surface side, and a third inclined surface inclining upward in the gravity direction from the first surface side to the second surface side at a position closer to the second surface than to the second inclined surface in this order from the first surface side.

20. The recording apparatus according to claim 19, wherein a supply pipe provided in the recording apparatus is inserted in a supply port of the liquid container, and an opening and the first inclined surface of the supply pipe face each other.

* * * * *